US009597782B2

(12) United States Patent
Abel

(10) Patent No.: US 9,597,782 B2
(45) Date of Patent: Mar. 21, 2017

(54) RATCHET HAVING AN OUTPUT SHAFT WHICH CAN BE DISPLACED TO AND FRO

(71) Applicant: Wera Werk Hermann Werner GmbH & Co. KG, Wuppertal (DE)

(72) Inventor: Michael Abel, Radevormwald (DE)

(73) Assignee: Wera Werk Hermann Werner GmbH & Co KG, Wuppertal (DE)

( * ) Notice: Subject to any disclaimer, the term of this patent is extended or adjusted under 35 U.S.C. 154(b) by 206 days.

(21) Appl. No.: 14/528,714

(22) Filed: Oct. 30, 2014

(65) Prior Publication Data

US 2015/0047474 A1 Feb. 19, 2015

Related U.S. Application Data

(63) Continuation of application No. PCT/EP2013/058163, filed on Apr. 19, 2013.

(30) Foreign Application Priority Data

Apr. 30, 2012 (DE) ..... 10 2012 103 782

(51) Int. Cl.
*B25B 13/46* (2006.01)
*B25B 23/00* (2006.01)

(52) U.S. Cl.
CPC ..... *B25B 13/463* (2013.01); *B25B 13/461* (2013.01); *B25B 13/465* (2013.01); *B25B 23/0035* (2013.01)

(58) Field of Classification Search
CPC ... B25B 13/461; B25B 13/463; B25B 13/465; B25B 13/46; B25B 23/0035
USPC ..... 81/177.85
See application file for complete search history.

(56) References Cited

U.S. PATENT DOCUMENTS 1,807,134 A * 5/1931 Pfauser ..... B25B 13/463 81/177.85
3,208,318 A 9/1965 Roberts
3,564,954 A * 2/1971 La Pointe ..... B25B 23/0035 81/61
3,638,519 A * 2/1972 Rebold ..... B25B 23/0035 81/177.85

(Continued)

FOREIGN PATENT DOCUMENTS

DE 20011367 U1 9/2000
DE 102004032341 A1 12/2005

(Continued)

*Primary Examiner* — David B Thomas
(74) *Attorney, Agent, or Firm* — Whitmyer IP Group LLC

(57) ABSTRACT

A screw tool having a gear head, which has a freewheel gear, having an output shaft, which is inserted in a non-rotatable but displaceable manner in an output opening and can be moved to and fro between a right-hand screw position and a left-hand screw position in each case by use of axial displacement, wherein in each case a different end section of the output shaft projects out of the gear head, having at least one locking mechanism to secure the position of the output shaft in the respective screw position and/or around a screw output element on the output shaft. As a development which is advantageous for use, the at least one locking mechanism can be moved from a locking position to a release position by pressure on an actuation element arranged on the end face of the output shaft.

11 Claims, 6 Drawing Sheets

(56) References Cited

U.S. PATENT DOCUMENTS

| | | | | | |
|---|---|---|---|---|---|
| RE28,037 | E * | 6/1974 | La Pointe | B25B 23/0035 | 81/61 |
| 4,408,504 | A * | 10/1983 | Dobosh | B25B 13/461 | 81/59.1 |
| 4,631,989 | A | 12/1986 | Trowbridge et al. | | |
| 4,939,961 | A * | 7/1990 | Lee | B25B 13/466 | 81/58.3 |
| 5,461,950 | A * | 10/1995 | Iwinski | B25G 1/063 | 81/61 |
| 5,619,890 | A | 4/1997 | Hattori et al. | | |
| 6,067,881 | A | 5/2000 | Albertson | | |
| 6,782,777 | B1 * | 8/2004 | Wei | B25B 23/0035 | 81/177.85 |
| 2003/0126957 | A1 * | 7/2003 | Huang | B25B 13/463 | 81/60 |
| 2005/0204868 | A1 | 9/2005 | Liu | | |
| 2006/0102442 | A1 * | 5/2006 | Dein | B25B 13/461 | 192/44 |
| 2007/0256525 | A1 * | 11/2007 | Lee | B25B 13/461 | 81/63.1 |
| 2008/0229888 | A1 * | 9/2008 | Ishmael | B25B 13/461 | 81/63.1 |
| 2008/0276762 | A1 * | 11/2008 | Dein | B25B 13/461 | 81/59.1 |
| 2010/0307297 | A1 * | 12/2010 | Chiang | B25B 13/466 | 81/63.1 |

FOREIGN PATENT DOCUMENTS

| | | | |
|---|---|---|---|
| DE | 202006019413 | U1 | 3/2007 |
| DE | 102007025078 | A1 | 12/2008 |
| DE | 202009000005 | U1 | 5/2010 |
| GB | 1428386 | A | 3/1976 |
| GB | 1428387 | A | 3/1976 |

* cited by examiner

RATCHET HAVING AN OUTPUT SHAFT WHICH CAN BE DISPLACED TO AND FRO

FIELD OF THE INVENTION

The invention relates to a screw tool having a gear head which has a freewheel gear, having an output shank which is inserted in a non-rotatable but displaceable manner in an output opening and which can be displaced to and fro between a right-hand screw position and a left-hand screw position in each case by means of axial displacement, in each case a different end portion of the output shank projecting out of the gear head, having at least one locking means to secure the position of the output shank in the two screw positions and/or to secure a socket on the output shank.

BACKGROUND OF THE INVENTION

A screw tool having a freewheel gear is shown in DE 20 2009 000 005 U1. There, an output shank is inserted in an output opening. The output opening has a square cross-section. Locking means are provided which hold the output shank in different axial positions. The output shank can assume a left-hand screw position in which an end portion of the output shank protrudes farther out of the gear head than the opposing end portion of the output shank so that a socket can be attached onto the output portion that protrudes farther out of the gear head, which socket, due to the directional lock, can be rotated only in one direction. The output shank can be axially displaced in such a manner that the other end portion protrudes farther out of the output opening than the now opposing end portion so that then a socket can be attached onto the other end portion, which socket can be used for screwing in the opposite direction of rotation.

A ratchet having a locking means which can be brought in a release position by actuating a pushbutton is described in U.S. Pat. No. 3,208,318 and DE 10 2004 032 341 A1.

DE 10 2007 025 078 A1 describes a torque transmission device having a switch-over latching ball.

U.S. Pat. No. 4,631,989 describes a plurality of exemplary embodiments of a ratchet. In one exemplary embodiment, the output shank is displaceably disposed in the ratchet head for the purpose of switching between left- and right-hand positions. In another exemplary embodiment, the output shank is fixedly connected to the ratchet head. In the output shank there is a pin which protrudes beyond the head's wide side opposite to the output shank. By applying pressure on the pin, a locking ball can be displaced from a locking position into a release position.

U.S. Pat. No. 6,067,881 describes a screw tool having a freewheel gear in the case of which an output shank protrudes out of the gear head, in which output shank there is an actuation pin which protrudes beyond the head's wide side opposite to the output shank. Here too, by applying pressure on the pin, a locking position can be displaced into a release position.

In the case of the aforementioned screw tool, the gear head is formed as a hammer. If a socket is attached onto the output shank, this socket has to be coupled to the output shank in an axially fixed manner. In addition, it has to be ensured that when using the tool as a hammer, the output shank does not change in an uncontrolled manner between its two screw positions.

SUMMARY OF THE INVENTION

It is an object of the invention to improve the generic tool in a manner that is advantageous for use.

The object is achieved by the invention specified in the claims, it being first and foremost substantially provided that the at least one locking means can be displaced from a locking position into a release position by pressure on an actuation element disposed on the end face of the output shank. This innovation can advantageously be implemented for a hammer ratchet as described in DE 20 2009 000 005 U1. In a preferred configuration it is provided that the locking position is a latching position into which the output shank cannot be displaced without prior actuation of the actuation element, or that the socket cannot be removed from the output shank without prior actuation of the actuation element. As a result of this configuration, the hammer ratchet preferably provided with the output shank formed according to the invention can be used as a hammer even with the socket attached thereon. The impacts occurring upon hammer actuation therefore do not result in an unintended displacement of the output shank or in disengagement of the socket from the output shank. The locking means can be inserted in a window of the output shank. The output shank can form an axial cavity in which an unlatching slide is inserted. The unlatching slide can be displaced in the axial direction. In its latching position, the unlatching slide holds the locking means in a form-fitting latching position in which it is inserted in certain regions in each case in a window of the output shank and in a locking or latching recess of the wall of the output opening formed as a passage channel. The locking means can be a ball. In the latching position, it can be located in a form-fitting manner in the locking recess of a core part of the gear head. The core part can be rotated relative to the gear head. Due to the directional lock, it can be rotated only in one direction so that by to and fro actuation of an arm protruding transverse to the screwing axis at the gear head, a screw connection can be tightened and/or untightened in steps. In a refinement of the invention it is provided that the actuation element is a pushbutton that acts on an unlatching slide. This pushbutton is located on the end face of the output shank. Preferably, both end faces of the output shank have a pushbutton, each of which is connected to an end of the unlatching slide. Here, each of the pushbuttons can protrude beyond the end face of the unlatching slide. One or more springs can be provided which hold the unlatching slide in a latching position. If axial pressure is applied onto one of the two pushbuttons, the unlatching slide is displaced from its latching position into an unlatching position, at least one of the at least one springs being tensioned. In a preferred configuration, two springs are provided which are biased in the opposite direction and which floatingly hold the unlatching slide in a latching position. The springs can be disposed in spring-accommodating chambers that are located in the region of the respective end portions of the unlatching slide and that can be supported on a step of the output shank, which step is formed by a bottom of the chamber. Cover caps can be attached on the free ends of the unlatching slide, on which cover caps the other ends of the springs, which are preferably formed as compression springs, are supported. The locking element preferably can assume two functional positions. In a first functional position, it holds the output shank in one of the two screw positions of the latter, wherein it blocks at least the displaceability. In the second functional position, it holds the socket on the output shank. Here too, the locking element performs at least a blocking function. The unlatching slide has unlatching recesses which are separated from one another by a support portion and into which the locking means can extend, which locking means is preferably formed by a ball. Between the two unlatching recesses there is a support portion which, in the latching position, holds the locking element in the locking position. Preferably, two locking means are provided which are axially spaced apart from one another and which upon displacement of the unlatching slide can change at the same time from their latching position into their release position. The axial spacing of the two locking means is larger than the axial length of the output opening in which the output shank is inserted so that two screw positions are possible, namely a right-hand screw position and a left-hand screw position, in each of which an end portion of the output shank protrudes farther beyond the wide side of the gear head than the respective other one. A socket can be attached onto the respective protruding end portion. The socket is then held by the locking means, the locking means, which is preferably formed as a ball, then locking in place in a locking recess of the socket. The freewheel gear is preferably a freewheel gear that cannot be switched over so that the screw directions depend on whether a screw output element, for example a socket, is attached on the one or the other of the two end portions of the output shank. Thus, by a swivel actuation of the arm of the screw tool forming a ratchet, the screw output element can be rotated either in the left-hand screw direction or the right-hand screw direction.

BRIEF DESCRIPTION OF THE DRAWINGS

An exemplary embodiment of the invention is explained with reference to accompanying drawings. In the figures:

FIG. 7 shows an exploded illustration of the essential elements of the core part of the screw tool;

FIG. 9 shows an illustration according to FIG. 8, but with the unlatching slide 8 displaced into the release position.

DETAILED DESCRIPTION OF THE INVENTION

Figure 1:
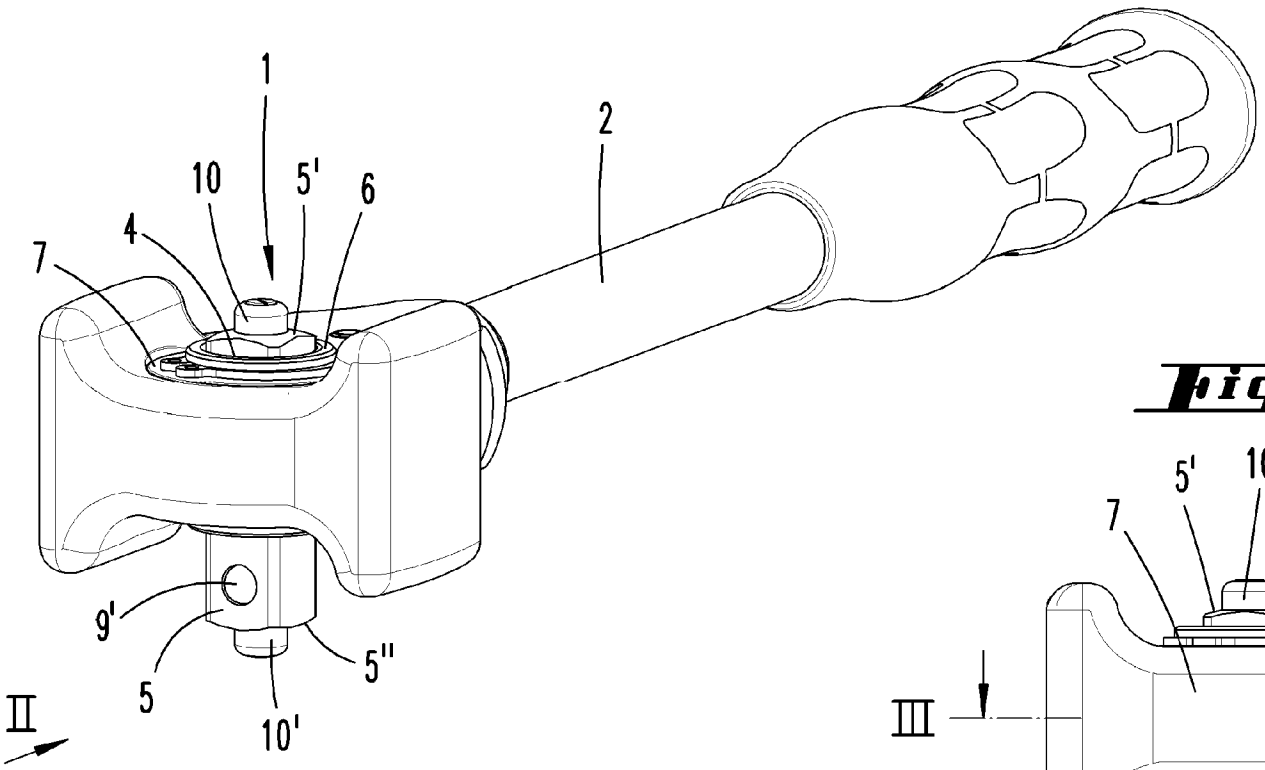
FIG. 1 shows a perspective illustration of a screw tool.
Figure 2:
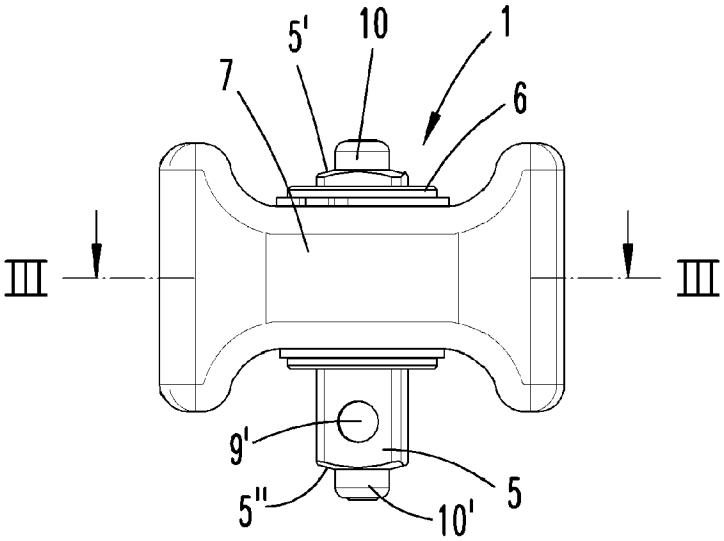
FIG. 2 shows the screw tool in a front view.

The exemplary embodiment is a hammer ratchet as it is described in DE 20 2009 000 005 U1, for example.

The tool has a gear head 1 that is fixedly connected to an arm 2. The gear head 1 has two diametrically opposing striking surfaces and is configured as a hammer ratchet. Between its two wide sides, the gear head has an opening, the wall of which forms a toothing 23. A core part 6 of the freewheel gear 3 is inserted in this opening. The freewheel gear 3 has pawls 19, each of which is acted on by a spring 20 so as to engage with the toothing 23 so that the core part 6 can be rotated only in one direction within the cavity accommodating the core part.

Thus, the gear head 1 forms a ring part 7 in which a core part 6 lies that is rotatable about an axis. The core part has an output opening 4 that extends in the axial direction and has a square cross-section. An output shank 5 having a square cross-section is inserted in the output opening 4, which is open on both wide sides. The axial length of the output shank 5 is greater than the axial length of the output opening 4 so that an end portion 5, 5' of the output shank 5 can protrude out of the output opening 4 at any time.

Within the wall of the output cavity 4, ring grooves 11, 11' are provided at two places that are axially spaced apart from one another, which ring grooves form the latching recesses.

Figure 3:
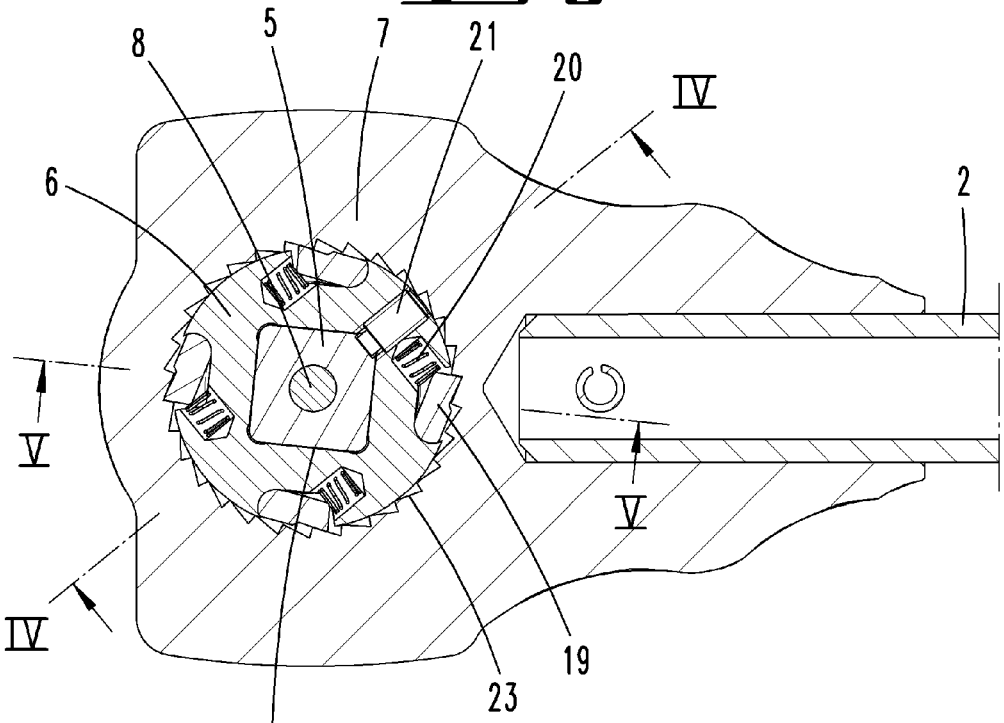
FIG. 3 shows the section along the line III-III in FIG. 2.
Figure 4:
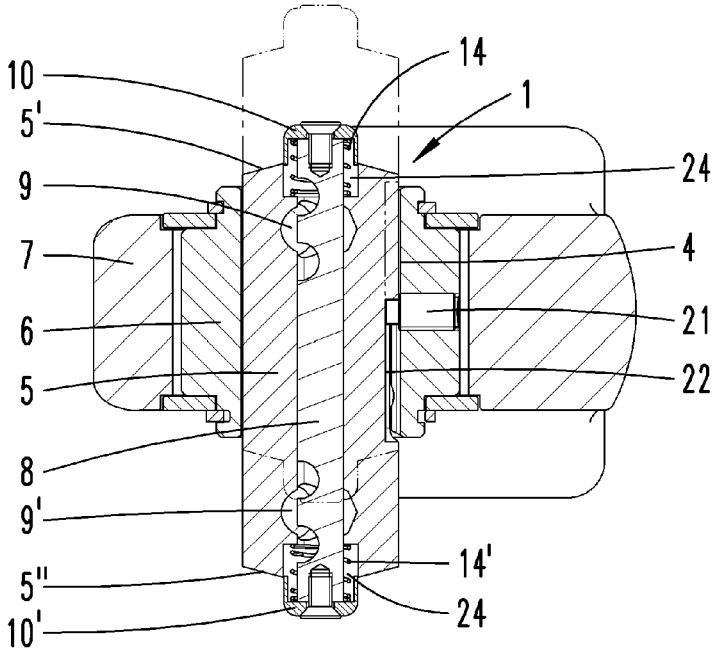
FIG. 4 shows the section along the line IV-IV in FIG. 3, wherein the output shank 5 assumes a first screw position and being displaceable by axial displacement into a second screw position, which is illustrated by a dot-dashed line.

It is shown in FIG. 3 and FIG. 4 that a grub screw 21 is inserted in the core part 6 in a cross hole thereof having an internal thread, which grub screw forms a shank end that has a tapered diameter and engages in a recess 22. The recess 22 is located in the region of an edge of the multi-edged output shank 5, and with its two ends that are spaced apart from one another, it forms limit stops against which the shank end of the grub screw 21 abuts when the output shank is displaced to and fro between a left-hand screw position and a right-hand screw position.

The output shank 5 has an axial cavity with a circular cross-section. In this axial cavity, an unlatching slide 8 is inserted in particular in a non-rotatable manner. The unlatching slide 8 is longer than the length of the axial cavity of the output shank 5. At its two ends, the axial cavity has end portions with increased diameters, each of which forms a chamber 24 in which a helical compression spring 14 is inserted. The chamber 24 forms a bottom formed by the output shank 5 on which one end of the spring 14 is supported.

An end cap is attached on each of the end faces of the unlatching slide 8, which end cap is fastened to the unlatching slide 8 by means of a screw, a rivet or the like or otherwise by adhesive bonding or welding, thus generally in a firmly bonding, force-fitting or form-fitting manner. The end cap forms a pushbutton 10, 10'. The end cap overlays the helical compression spring 14, 14' so that the two springs acting in the opposite direction hold the unlatching slide 8 in a central neutral position. The unlatching slide 8 is floatingly held in a latching position by two springs.

Figure 5:
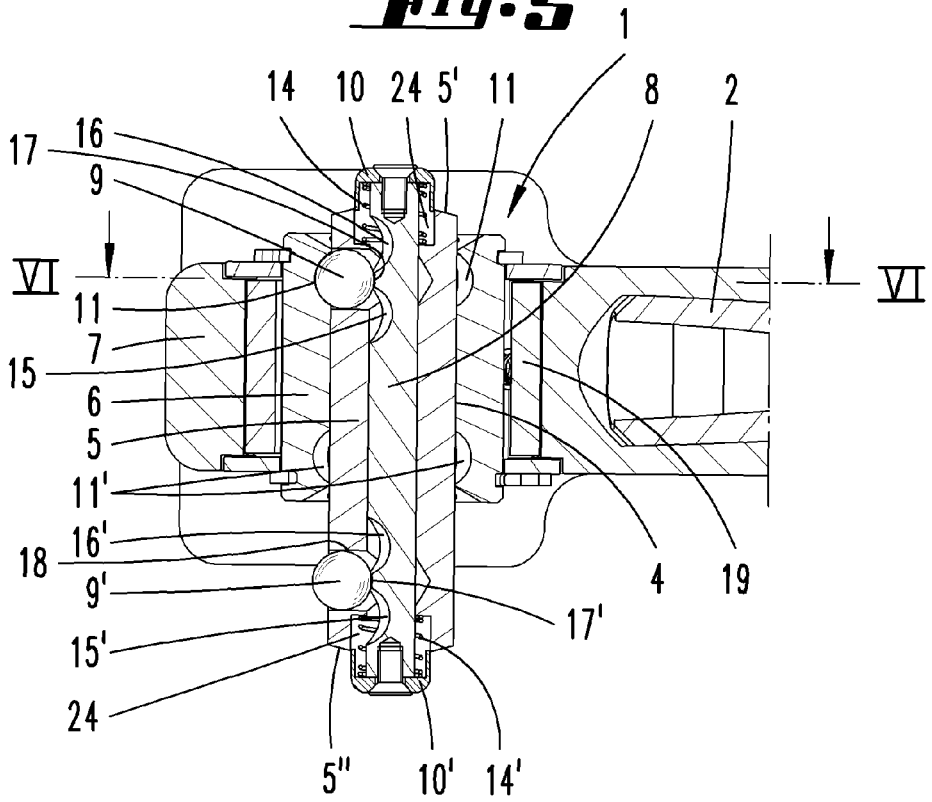
FIG. 5 shows the section along the line V-V in FIG. 3, wherein the unlatching slide 8 assumes its latching position.
Figure 6:
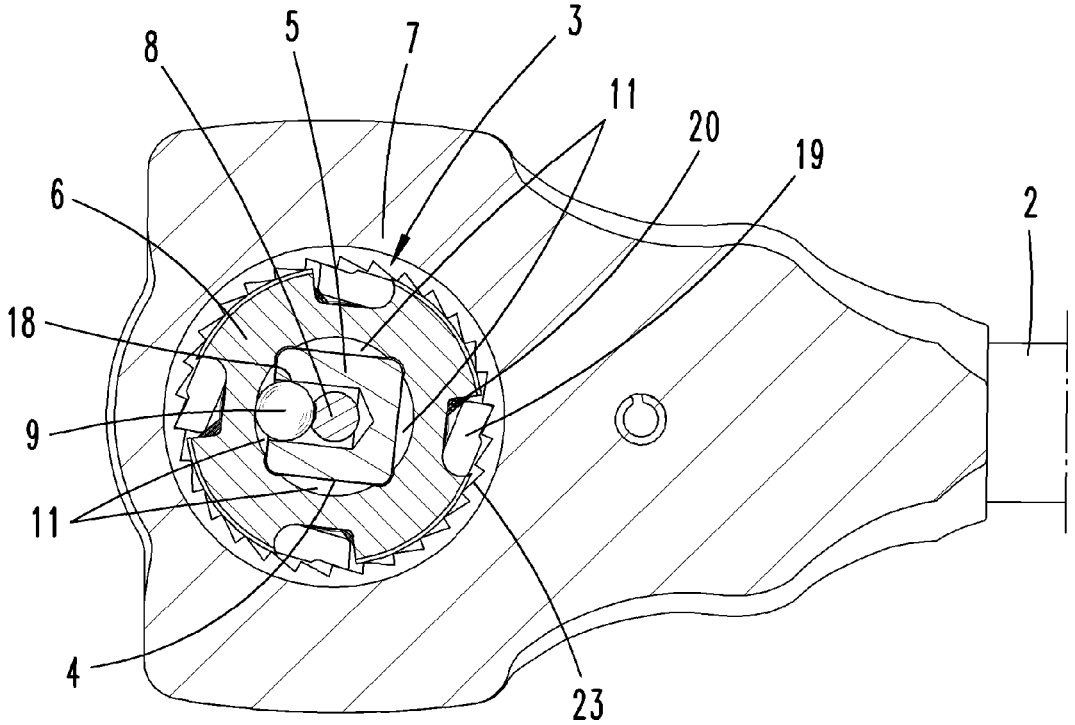
FIG. 6 shows a section along the line VI-VI in FIG. 5.
Figure 4:
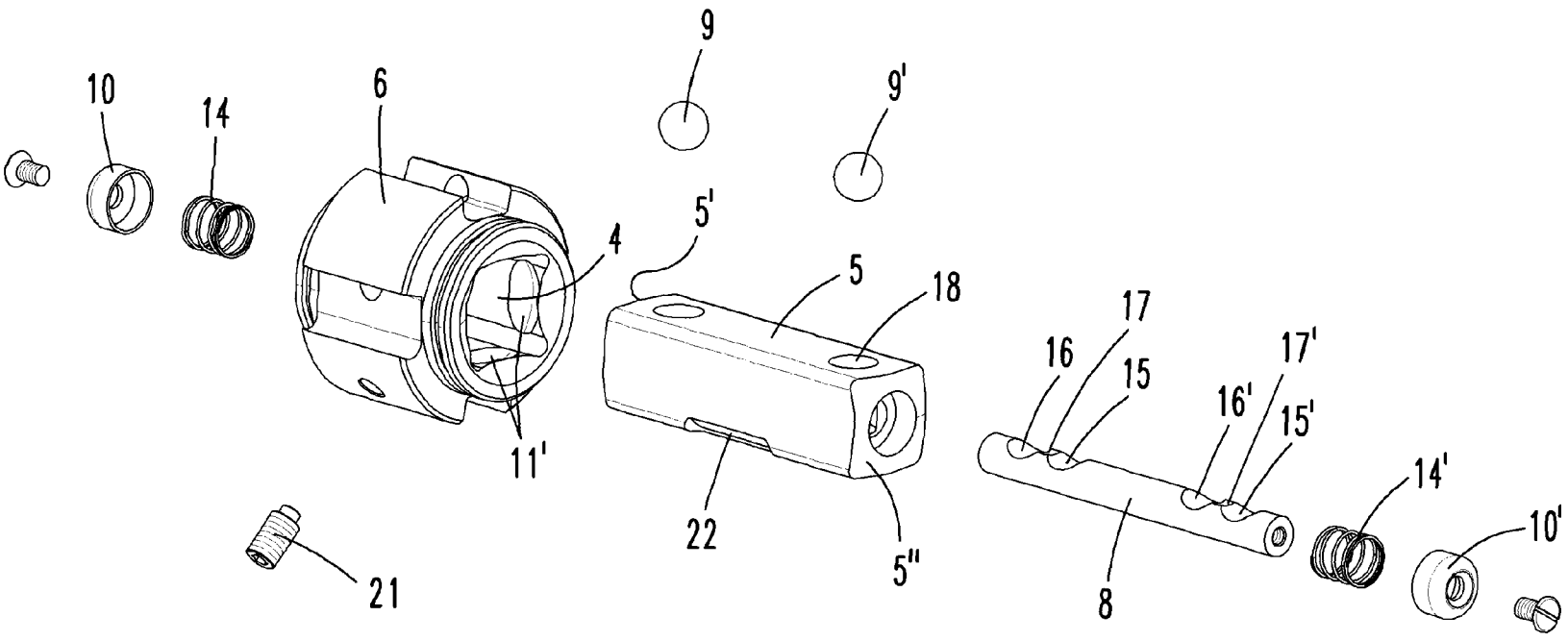
Figure 6:
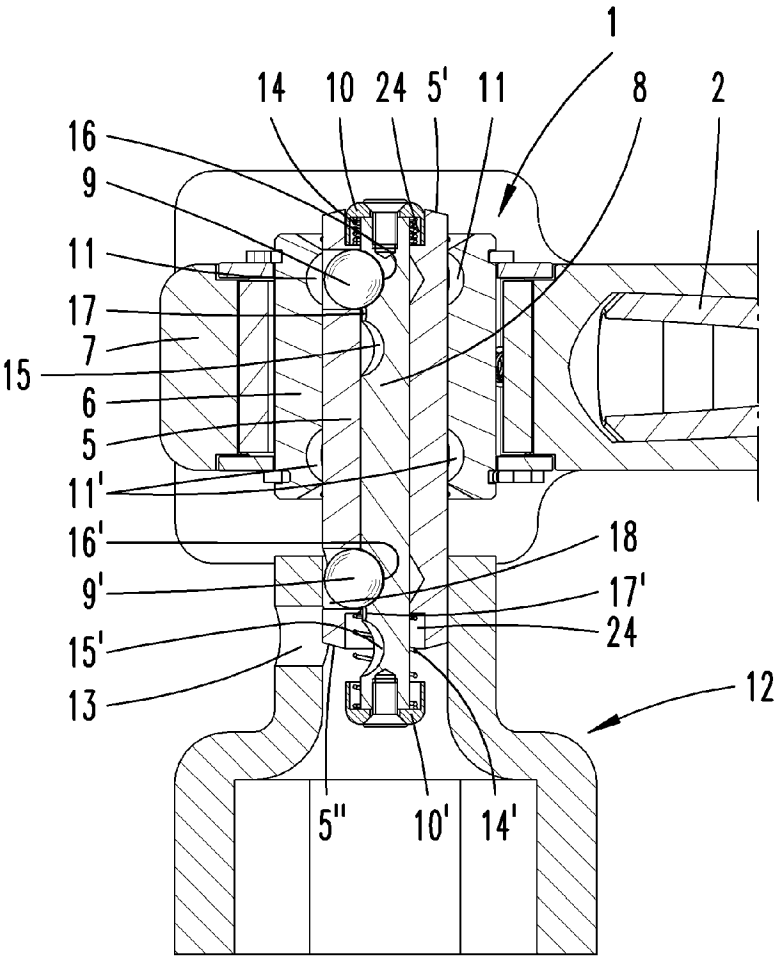

The output shank 5 has two windows 18 which are axially spaced apart from one another and in each of which lies a locking element in the form of a ball 9, 9'. In the latching position illustrated in FIG. 5, the balls 9, 9' are each supported on support portions 17, 17' of the unlatching slide 8 and thereby are form-fittingly held in a latching position. One of the two locking balls 9, 9' engages in one of the two latching recesses 11, 11' in order to hold the output shank 5 in a form-fitting manner in one of the two screw positions. The support portion 17, 17' is located between two unlatching recesses 15, 15', 16, 16'. If the unlatching slide 8, starting from the position illustrated in FIG. 5, is displaced in the one or the other axial direction, one of the unlatching recesses 15, 15' 16, 16' moves into a rearward position of the locking ball 9, 9' so that the locking ball 9, 9' can extend in the radial direction into this unlatching recess 15, 15', 16, 16'. The locking ball 9, 9' then extends completely into the output shank 5.

Figure 8:
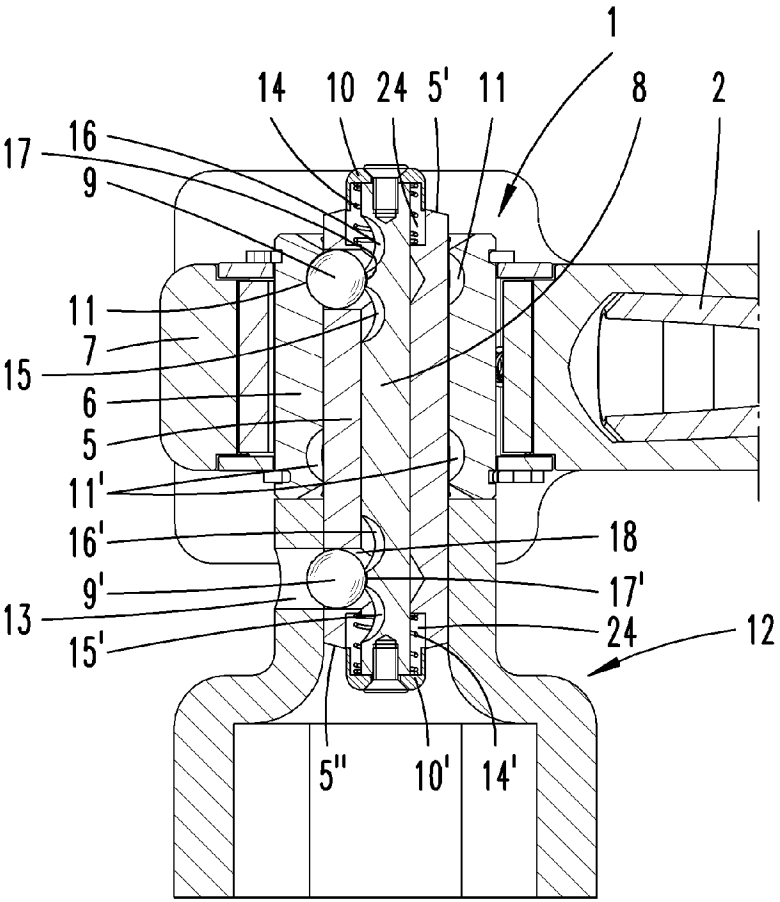
FIG. 8 shows an illustration according to FIG. 5, but with the socket 12 attached on the end of the output shank 5 protruding out of the gear head 1.

It is apparent from the FIG. 8 that the locking ball 9 lies in one of the two latching recesses 11 while the other locking ball 9' can extend into a latching recess 13 of the socket 12 in order to fix the socket 12 in a form-fitting manner to the output shank 5. As illustrated in the drawings, the latching recess 13 can be formed by a through hole. As an alternative, it can also be formed by an internal spherical dome.

In order to detach the socket 12 from the output shank 5, axial pressure has to be applied to the pushbutton 10 of the unlatching slide 8 so that the unlatching slide 8 can be displaced from its latching position illustrated in FIG. 8 into its unlatching position illustrated in FIG. 9. In this unlatching position, the locking balls 9, 9' can come out of their latching positions 11 and 13, respectively. The socket 12 can now be removed from the output shank 5.

In order to axially displace the output shank 5 with respect to the gear head 1, pressure is to be exerted on the pushbutton 10'.

Figure 10:
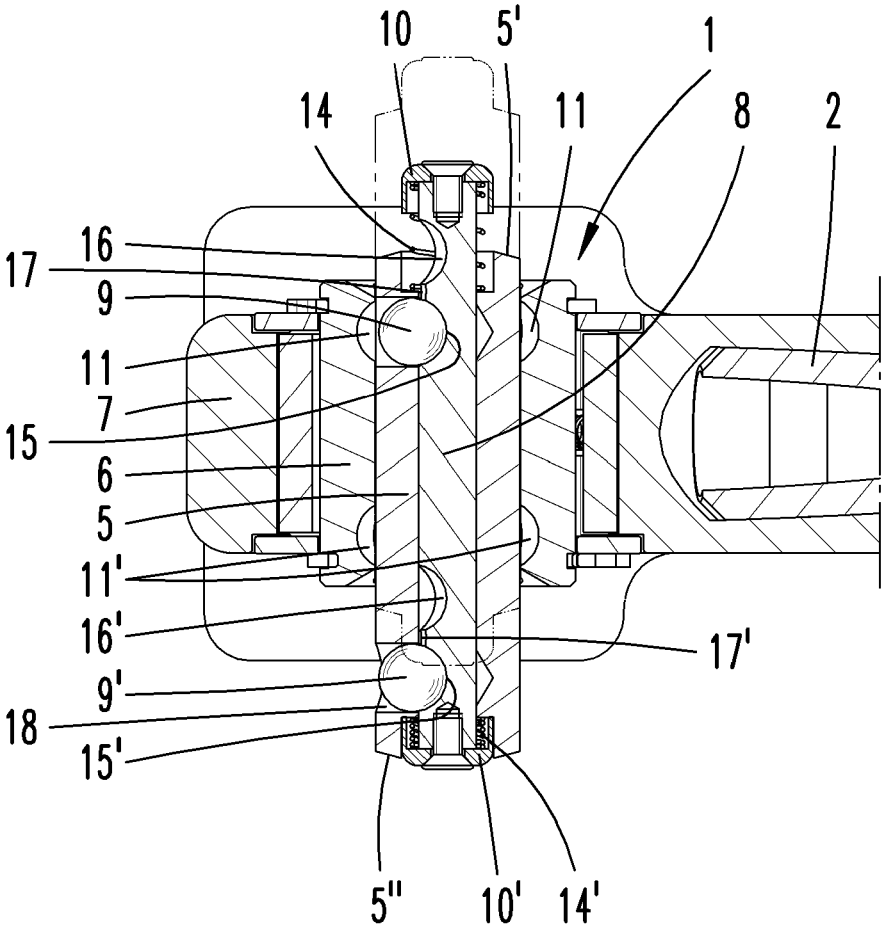
FIG. 10 shows an illustration according to FIG. 5, wherein the unlatching slide 8 has been brought in a different direction into the release position.

If, for example, the position illustrated in FIG. 5, FIG. 8 and FIG. 9 is a right-hand screw position, the output shank 5 can be moved into a left-hand screw position by pressure on the downwardly facing pushbutton 10', as shown in FIG. 10. During the associated axial displacement of the unlatching slide 8 relative to the output shank 5, the unlatching recess 15' moves into a position rearward of the locking ball 9' and the unlatching recess 15 moves in a position rearward of the locking ball 9. The locking ball 9 lying in the latching recess 11 thus can travel into a release position, which is illustrated in FIG. 10. The pressure exerted on the pushbutton 10' then enables the axial displacement of the output shank 5 into the position shown in FIG. 10 by a dot-dashed line.

In this position, the window 18 is aligned with the latching recess 11' so that after releasing the pushbutton 10', the spring 14' can relax again with the result that the unlatching slide 8 assumes its latching position. In the process of this, the locking ball 9' is displaced into the latching recess 11' and is held there by the support portion 17.

In the exemplary embodiment, a total of two locking balls 9, 9' lie selectively in each case in one of two latching recesses 11, 11', wherein the respective other latching ball 9, 9' is able to fix a socket 12 in place on the output shank 5.

When switching over the output shank 5 from the left-hand screw position to the right-hand screw position or vice versa, the unlatching direction corresponds to the displacement direction of the output shank so that the pressure on the pushbutton 10, 10' protruding beyond the end face 5', 5" effects in first instance an unlatching and subsequently an output displacement.

In an exemplary embodiment that is not illustrated here, the pushbutton 10, 10' can also lie flush with its end face in an end face opening of the output shank. Further, more than three latching balls 9 can be provided. In particular, it is possible that only one latching recess is provided in the output opening 4, for example in the axial center thereof.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

REFERENCE LIST

1 Gear head
2 Arm
3 Freewheel gear
4 Output opening
5 Output shank "end face"
6 Core part
7 Ring part
8 Unlatching slide
9 Locking means/latching ball
10 Pushbutton
11 Latching recess
12 Socket
13 Latching recess
14 Spring
15 Unlatching recess
16 Unlatching recess
17 Support portion
18 Window
19 Pawl
20 Spring
21 Grub screw
22 Recess
23 Toothing
24 Chamber

What is claimed is:

1. A screw tool having a gear head which has a freewheel gear, having an output shaft which is inserted in a non-rotatable but displaceable manner in an output opening and can be displaced to and fro between a right-hand screw position and a left-hand screw position in each case by means of axial displacement, in each case a different end portion of the output shaft projecting out of the gear head, having at least one locking means to secure the position of the output shaft in the respective screw position and/or to secure a screw output element on the output shaft, the at least one locking means being held in a locking position by an unlatching slide disposed in an axial cavity of the output shaft and being displaceable from a locking position into a release position by pressure on actuation elements disposed on each end face of the output shaft, characterized in that the locking position is a form-fitting latching position that can only be released by axial pressure onto one of the two actuation elements so that in the locking position, the screw output element which, for example, is formed as a socket, cannot be removed from the output shaft.

2. The screw tool according to claim 1, characterized by a plurality of latching recesses which are disposed in the wall of the output opening and in which the locking means engages in the locking position.

3. The screw tool according to claim 1, characterized in that the actuation element is a pushbutton which acts on an unlatching slide and by means of which the unlatching slide can be brought out of the latching position in particular against the reset force of one or a plurality of springs.

4. The screw tool according to claim 1, characterized in that the unlatching slide is held in the latching position by two springs that act in opposite directions.

5. The screw tool according to claim 1, characterized in that upon displacement of the output shaft between its two screw positions, the locking element changes from a first functional position that at least blocks the displaceability of the output shaft into a second functional position that at least blocks the removal of the socket from the output shaft.

6. The screw tool according to claim 1, characterized in that in an unlatching position, the locking means extends into an unlatching recess of the unlatching slide.

7. The screw tool according to claim 6, characterized by two unlatching recesses which can alternately be brought into action and between which a support portion is disposed which holds the locking means in its latching position in which it is inserted in a latching recess of a core part of the gear head.

8. The screw tool according to claim 1, characterized in that the locking means is a ball.

9. The screw tool according to claim 1, characterized in that two locking means are provided that have an axial spacing between one another that is larger than the axial length of the cavity of a core part of the gear head, in which cavity the output shaft is inserted.

10. The screw tool according to claim 9, characterized in that the core part is inserted in an opening of the gear head to be rotatable in a directionally locked manner, the gear head being fixedly connected to a drive arm.

11. The screw tool according to claim 1, characterized in that the freewheel gear has pawls that engage with a toothing and are acted on by a spring.

* * * * *